United States Patent [19]

Ibarra

[11] Patent Number: 4,864,912

[45] Date of Patent: Sep. 12, 1989

[54] BREECHBLOCK WITH FIRING PIN FOR MORTARS

[75] Inventor: Iñigo A. Ibarra, Vizcaya, Spain

[73] Assignee: Esperanza y Cia., S.A., Spain

[21] Appl. No.: 175,520

[22] Filed: Mar. 31, 1988

[51] Int. Cl.[4] ..... F41F 13/00; F41F 1/06

[52] U.S. Cl. ..... 89/27.11; 89/1.35; 89/37.05; 89/37.13

[58] Field of Search ..... 89/1.3, 1.35, 27.11, 89/37.05, 37.13, 40.02

[56] References Cited

U.S. PATENT DOCUMENTS

| | | | |
|---|---|---|---|
| 2,307,009 | 1/1943 | Adelman | 89/1.3 |
| 2,558,024 | 6/1951 | Weiss et al. | 89/37.05 |
| 4,744,283 | 5/1988 | Ibarra | 89/37.05 |

*Primary Examiner*—Stephen C. Bentley
*Attorney, Agent, or Firm*—Lucas & Just

[57] ABSTRACT

Breechblock with firing pin for mortars, which has barrel (1), breechblock (2), and base plate (3) united as follows:

(a) barrel (1) to breechblock (2), using at least one key (8) accomodated in key seat (11) of barrel (1) and provided with holes (81) into which pins (8) are inserted; and at least one screw (7) accomodated in a threaded hole (21) of breechblock (2), said screw (7) defining two coaxial zones in its body, one of greater diameter of external treading (71) which is attached in breechblock (2), and another of smaller diameter provided with perimetral neck (72) in which pins (9) positioning key (8) are accomodated;

(b) breechblock (2) to base plate (3) with possibility of turning in space, using positioning head (26) in the end of breechblock (2); support flange (4) over platform base (3); cover rib (5) attached by screw (20) over support flange (4) and which holds rib (6) in it, into which said head (26) of breechblock (2) runs.

Breechblock (2) includes means (22, 23, 24) for mounting firing pin (10), these means being: in firing pin (10), a head with truncated cone base (**10*b*) and a percussion pin of cylindrical form (10*a*) topped out as a spherical cap; rear body (10*d*) provided with positioning stop (10*e*); central body (10*c*) with outside threading, of greater diameter than rear body (10*d***) and which unites the head with the rear body.

3 Claims, 1 Drawing Sheet

BREECHBLOCK WITH FIRING PIN FOR MORTARS

Mortars (artillery pieces intended for firing bombs) consisting of barrel and breechblock, the unit being arranged on a base plate and provided with percussion means (firing pins) to make the discharge, are currently known.

In these conventional mortars, which exist in the current technology, there are too many complex features, especially the union form between barrel and breechblock, the design of the firing pin, and the assembly method of the unit to the base plate.

These limitations can become important, considering the use conditions for this type of equipment (under extreme conditions and in wartime).

Attempts have consequently been made to incorporate improvements in mortars intended to eliminate the above mentioned limitations and to offer possibilities for: combining or releasing the barrel from the breechblock rapidly and to assemble or disassemble the unit on the base plate rapidly, especially with the possibility of free turning.

Figure 1:
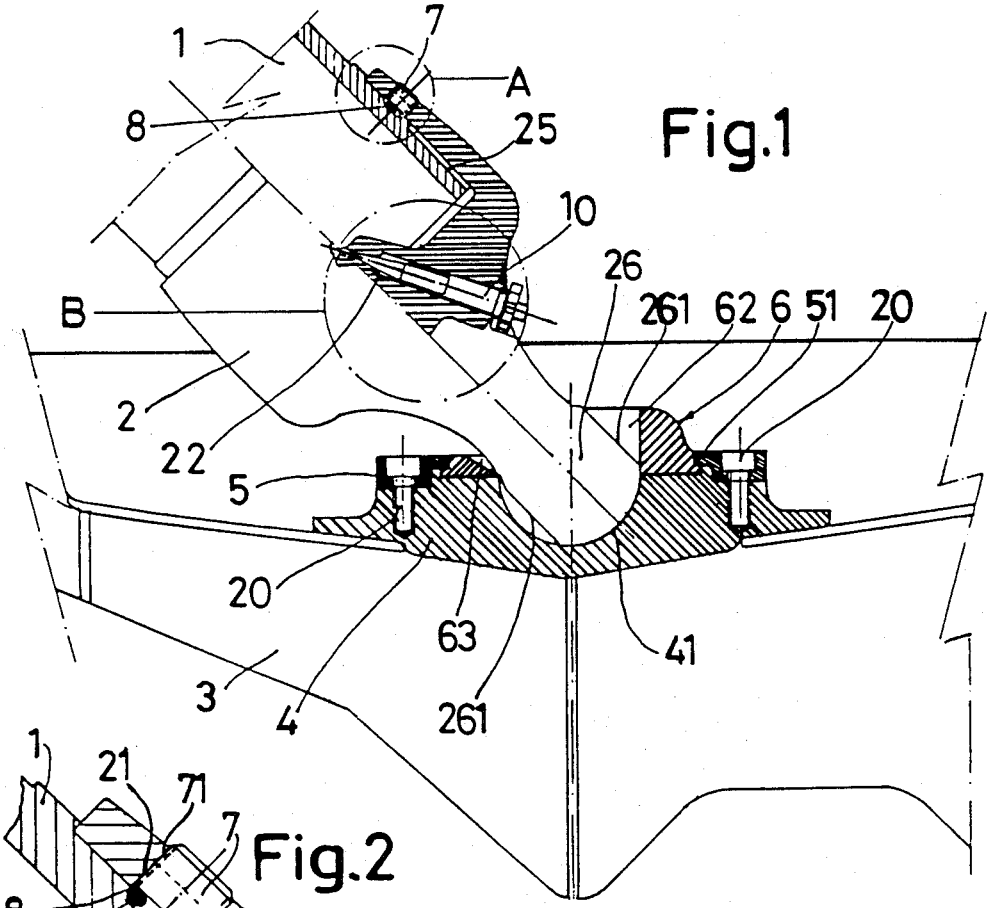

FIG. 1 presents a general view of the breechblock, with firing pin hammer for mortars according to the invention, partially in section to observe its most important features.

Figure 2:
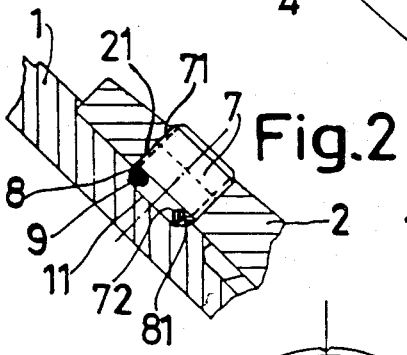

FIG. 2 presents an expanded detail according to indication A of FIG. 1.

Figure 3:
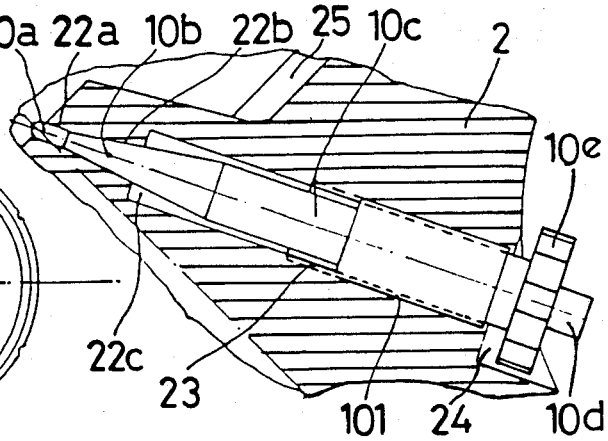

FIG. 3 presents an expanded detail according to indication B of FIG. 1.

Figure 4:
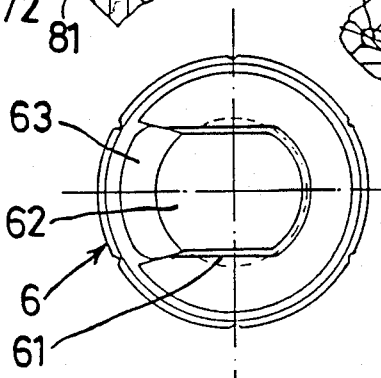

FIG. 4 presents a horizontal projection view of the flange (6).

The invention includes barrel (1), breechblock (2) and base plate (3), and it provides for its assembly:

(a) means (7, 8) for attaching barrel (1) to breechblock (2);

(b) means (4, 5, 6) for positioning breechblock (2) on base plate (3) with the possibility of free turning in space.

According to the form of execution represented, FIGS. 1 and 2, said means (7, 8) for combining barrel (1) and breechblock (2) together are: threaded hole (21) in breechblock (2), key seat (11) in barrel (I), key (8) seated in key seat (11) and provided with holes (81) in which pins (9) and screw (7) which defines two zones of different diameters are accomodated, one threaded externally (71) and another with perimeter neck (72) in which pins (9) ar accomodated.

According to the form of execution represented, FIGS. 1 and 3, the means for mounting firing pin (10) in breechblock (2) are: through hole (22), in which firing pin (10) is accomodated, whose head (**10*a*) reaches receptacle (25**), which is contacted by the (unrepresented) projectile to make the discharge.

Through hole (22) defines several coaxial zones (see FIG. 3). In the form of execution represented, these zones are: a first zone (**22*a*) of small diameter; a second truncated cone zone (22*b*) seat; a third truncated cylinder zone (22*c*), at least partially threaded (23); and outlet box (24**).

Firing pin (10) also correspondingly defines several coaxial zones (see FIG. 3). These zones define: a head with a base of truncated cone form (**10*b*) and a percussion pin (10*a*) of cylindrical form topped out as a spherical cap, said cap projecting slightly in relation to breechblock (2) in receptacle (25); a truncated cylinder central body (10*c*) at least partly threaded (101); and a rear body (10*d*) provided with positioning stop (10*e*), said stop (10*e*) accomodating in box (24**).

According to the form of execution represented (FIGS. 1 and 4), the means for positioning breechblock (2) on base plate (3) are: positioning head (26) in the end of body or block (2); support flange (4) on base plate (3); cover rib (5) attached to support flange (4), between which flange (6) is arranged, into which said positioning head (26) runs.

Positioning head (26) is of spherical form with diametrically opposite broad beveled edges (261).

Support flange (4) centrally has spherical cavity (41) in which head (26) is located.

Support flange (4) and cover rib (5) are attached together, for example by screws (20).

Cover rib (5) bears fins (51) for positioning rib (6) between them and flange (4).

Rib (6) has inlet mouth (61) with front opening (62) which permits entry of positioning head (26) with its beveled edges (261) through it parallel to the walls of inlet mouth (61) and location of head (26) in opening (41) of flange (4). Later, by a simple turn of barrel (1), head (26) is retained in opening (41) of flange (4) without being able to go out of it. Rib (6) also has ramp (63), which makes it possible to attain a greater maximum discharge inclination.

I claim:

1. Breechblock with firing pin for mortars, characterized by the fact that same has barrel (1), breechblock (2) and base plate (3), and the following items are available for their union:

(a) means (7, 8) for attaching barrel (1) to breechblock (2); these means being:

($a_1$) at least one key (8) accomodated in key seat (11) of barrel (1) and provided with holes (81) into which pins (9) are inserted;

($a_2$) at least one screw (7) accomodated in threaded hole (21) of breechblock (2); said screw (7) defines two coaxial zones in its body, one of greater diameter of external threading (71) which is secured in breechblock (2), and another of smaller diameter provided with perimeter neck (72), in which pins (9) positioning key (8) are accomodated;

(b) means (22, 23, 24) for assembling firing pin (10) in breechblock (2); these means are:

($b_1$) in the firing pin, a head with truncated cone base (**10*b*) and a percussion pin (10*a*) of cylindrical form topped out as a spherical cap; rear body (10*d*) provided with positioning stop (10*e*); a central body (10*c*) with external threading of greater diameter than rear body (10*d***) and which unites the head with the rear body;

($b_2$) in the body of breechblock (2), outlet hole (**22*a*) of the point of percussion pin (10*a*); a truncated cone seat (22*b*) for its adjustment with said head (10*b*); and cylindrical hole (22*c*) at least partly threaded (23) for the location of said central body (10*c***);

(c) means (4, 5, 6) for positioning breechblock (2) on base plate (3), with turn possibility in space, these means ($c_1$) positioning head (26) in the end of breechblock (2);

($c_2$) support flange (4) over platform base (3);

($c_3$) cover rib (5) attached by screw (20);

($c_4$) rib (6) into which said head (26) of breechblock (2)

2. Breechblock with firing pin for mortars according to claim 1, characterized by the fact that said head (26) of breechblock (2) exhibits a spherical form with diametrically opposite broad beveled edges (261).

3. Breechblock with firing pin for mortars according to claim 2, characterized by the fact that said rib (6) presents inlet mouth (61) provided with flat opening (62) beveled on one of its sides to achieve a greater maximum discharge inclination, so that, on inserting head (26) into said opening (62) with its beveled edges parallel to inlet mouth (61), removal is prevented with a small rear turn of barrel (1) without impairment of free turning in space.

* * * * *

UNITED STATES PATENT AND TRADEMARK OFFICE

CERTIFICATE OF CORRECTION

PATENT NO. : 4,864,912

DATED : September 12, 1989

INVENTOR(S) : Inigo Arana-Ibarra

It is certified that error appears in the above-identified patent and that said Letters Patent are hereby corrected as shown below:

Abstract line 6, change "treading" to --threading--.

Column 1, line 50, change "ar" to --are--.

Column 2, line 62, after "means" insert --being:--; line 68, after "(2)" insert --runs.--.

Signed and Sealed this

Twenty-seventh Day of November, 1990

*Attest:*

HARRY F. MANBECK, JR.

*Attesting Officer*

*Commissioner of Patents and Trademarks*